United States Patent [19]

Pietzka et al.

[11] 4,111,794

[45] Sep. 5, 1978

[54] METHOD OF PRODUCING PITCH COKE

[75] Inventors: Gerhard Pietzka, Vockenhausen; Harald Tillmanns, Kelkheim, both of Germany

[73] Assignee: Sigri Elektrographit GmbH, Meitingen bei Augsburg, Germany

[21] Appl. No.: 783,029

[22] Filed: Mar. 31, 1977

[30] Foreign Application Priority Data

Apr. 3, 1976 [DE] Fed. Rep. of Germany ..... 2614448

[51] Int. Cl.[2] ..... G10G 9/14

[52] U.S. Cl. ..... 208/131; 208/88; 423/445; 423/448; 423/449

[58] Field of Search ..... 208/85, 87, 88, 131, 208/132, 50; 423/445, 450, 449

[56] References Cited

U.S. PATENT DOCUMENTS

| | | | |
|---|---|---|---|
| 2,775,549 | 12/1956 | Shea | 208/131 X |
| 3,617,515 | 11/1971 | Bloomer | 208/131 |
| 3,799,865 | 3/1974 | Suetsugu et al. | 208/131 |

FOREIGN PATENT DOCUMENTS

| | | | |
|---|---|---|---|
| 2,064,695 | 1/1973 | Fed. Rep. of Germany | 208/131 |
| 2,434,295 | 1/1976 | Fed. Rep. of Germany | 208/131 |

*Primary Examiner*—Edward J. Meros
*Attorney, Agent, or Firm*—Herbert L. Lerner

[57] ABSTRACT

Manufacture of pitch coke with needle-like structure by mixing pyrolysis oil condensate formed in the process with a coal-tar pitch having a softening point between 70° and 150° C, filtering the mixture at a temperature 100° to 200° C above the softening point, heating the filtrate to a temperature between 450° and 525° C in a tubular heater and coking the heated filtrate in a coking drum, passing volatile pyrolysis products from the drum to a fractionating column for separation of pyrolysis oil condensate from non-condensible gas.

5 Claims, 3 Drawing Figures

METHOD OF PRODUCING PITCH COKE

BACKGROUND OF THE INVENTION

1. Field of the Invention

This invention relates to coke and more particularly refers to a new and improved method for the manufacture of pitch coke with needle-like texture.

2. Description of the Prior Art

In the production of pitch coke with needle-like texture, it is known, for instance, according to the German Published Prosecuted Application Nos. 1,189,517 and 1,257,738, to separate from the coal-tar pitch by filtration, sedimentation or similar separation methods, the substances which are detrimental to the development of a needle-like texture, particularly the soot-like and mineral components insoluble in quinoline. For this purpose, the pitch is heated to a temperature above the softening point, or the separation is promoted by additions of solvents such as wash oil or anthracene oil. Separation by filtration is particularly simple if a fairly large amount of substances containing low-boiling aromatic compounds, such as, for instance, tar oils, are added to the coal tar pitch. Such oils facilitate the filtration of the coal tar pitch and improve the selectivity of the separation, i.e. they make it possible to remove almost completely the component insoluble in quinoline. After the filtration, the tar oils are separated from the purified pitch by distillation or are carbonized according to the German Published Prosecuted Application No. 2,064,695, together with the filtrate at temperatures between 450° and 500° C. The coke yield attainable with the last-mentioned method is relatively low because of the large share of highly volatile substances. The green- or raw-coke yield is only about 49 to 63% and the yield of a calcined coke produced by heating to 1300° C. might be 45 to 57%. Although this disadvantage can be avoided by separating the low-boiling compounds by distillation, prior to the coking, this can be done only at the expense of an additional process step.

SUMMARY OF THE INVENTION

An object of the present invention is to provide a method of improving the coke yield attainable by coking of coal-tar pitch filtrates without detracting from the filterability of the raw pitch used, or without separating the low-boiling components prior to the coking. A further object of the invention is to produce a pitch coke with a needle-like texture and a particularly small thermal volume expansion coefficient. Another object of the invention is to provide a method of substantially reducing the energy required for a combined filtration and coking process.

With the foregoing and other objects in view there is provided in accordance with the invention a method for the manufacture of pitch coke with needle-like structure which includes mixing pyrolysis oil condensate formed in the coking of coal-tar pitch with a coal-tar pitch having a softening point between 70° and 150° C., filtering said mixture of condensate and pitch at a temperature 100° to 200° C. above the softening point of the pitch, passing the filtrate in a restricted stream through a heating zone and heating the filtrate therein to a temperature between 450° and 525° C., discharging the thus heated filtrate to a coking chamber wherein the heated filtrate forms a non-volatile carbonaceous residue as coke and volatile vapor and gas, releasing the volatile vapor and gas from the coking chamber and passing the vapor and gas to a fractionating zone in which the vapor is condensed to form pyrolysis oil condensate, withdrawing the condensate from the fractionating zone, and returning at least a part of the condensate for mixing with additional incoming coal-tar pitch prior to the filtering.

Other features which are considered as characteristic for the invention are set forth in the appended claims.

Although the invention is illustrated and described herein as embodied in a method of producing pitch coke, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
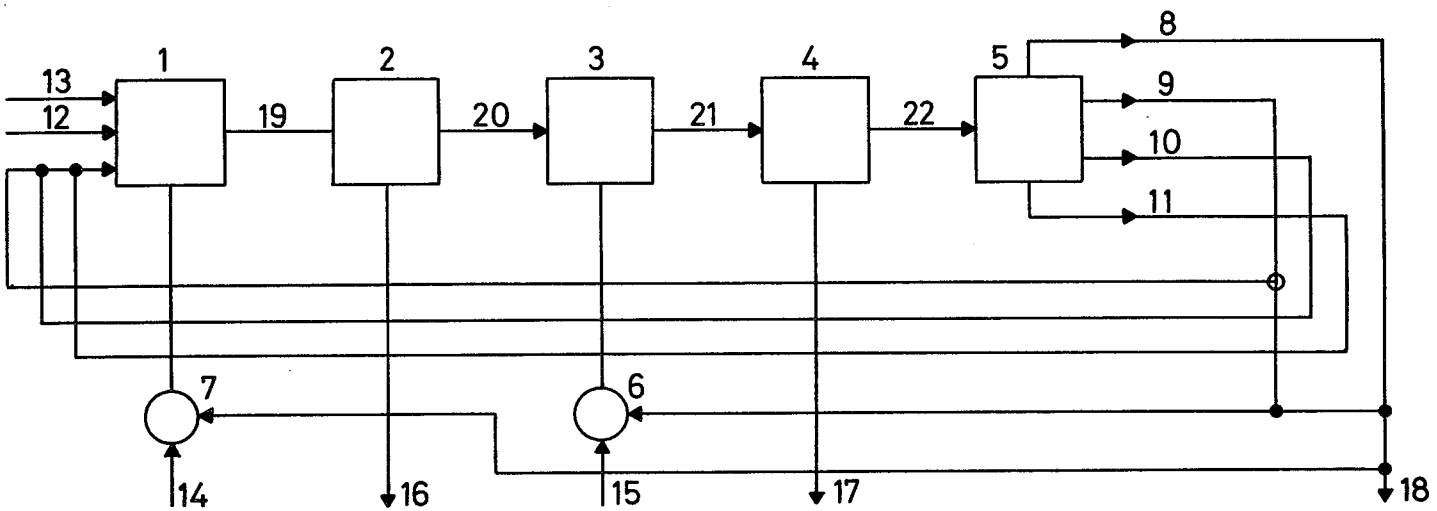
FIG. 1 is a flow diagram of the method of producing pitch coke with needle-like structure in accordance with the invention.

The condensable products of pyrolysis formed during the coking of the filtrate are recirculated at least in part and are added to the feed pitch entering the system. The recirculated condensable pyrolysis products surprisingly reduce the viscosity of coal-tar pitches and improve their filterability to such an extent that the use of pitches with a higher softening point now becomes possible. Such higher softening point pitches yield a large coke residue in coking. The addition of recirculated pyrolysis products results in a substantial increase of the filter efficiency and an almost complete separation of the quinoline-insoluble components which are detrimental to the coke quality, so that a pitch coke with a particularly low thermal volume expansion coefficient is produced with a large yield. The use of coal-tar pitches with a softening point between 80° and 150° C. as the raw material is particularly advantageous. Also mixtures of two or more coal-tar pitches, the softening points of which differ by more than 20° C. are desirable. In a preferred embodiment of the method, a coal-tar pitch or mixtures of several coal-tar pitches are mixed with 5 to 30% by weight of condensable pyrolysis oils, the mixture filtered and fed in a restricted stream for coking, for example, to tubular heaters followed by coking drums. The semicoke or green coke produced in subsequently calcined in known manner in rotary tube ovens, disk ovens and the like by heating it to about 1300° C.

Hot filtration of the coal-tar pitch/tar oil mixture is improved by adding to the mixture a filtering aid, e.g. kieselguhr (diatomaceous earth) in amounts of up to 5% and heating the mixture in a preheater to a temperature of about 100° to 200° C. above the softening point of the mixture. Pressure filters such as, for example, filter cartridges which permit pressures of about 10 bar are particularly well adapted for filtering the mixture. The filter output is about 400 to 800 kg/m$^2$hr, depending on the raw coal-tar pitch used and the percentage of recirculated oil. The filtrate contains less than 0.3% quinoline-insoluble components and less than 0.1% mineral substances. The purified filtrate is then heated for example, in a tubular heater, to a temperature of about 450° to 500°-525° C. and then coked in coking drums. In "delayed coking", the hot mixture of pitch and condensate from the tubular furnace is charged directly to an enlarged vertical coking drum, generally at a point at or near the bottom of the coking drum. The non-volatile constituants are retained in the coking drum and the coking reaction takes place therein. Coke is deposited in the coking drum while the volatile products of the coking reaction are released from the top of the drum and directed to a fractionating tower. To permit continuity of operation, when the drum fills with coke to a designated level, the flow of hot mixture is diverted to a second coke drum. Coke is removed from the first drum and it is prepared to receive the hot mixture after the second drum fills with coke. Switching of drums usually occurs every 20 to 36 hours. The condensable pyrolysis products generated are separated in the fractionating tower and recirculated at least in part and added to the raw coal-tar pitch. A second portion of the pyrolysis oil condensate may be used as fuel for heating the preheater and the tubular heater. The non-condensed gaseous pyrolysis products may likewise serve as fuel for this purpose.

Referring to FIG. 1, coal-tar pitch, having a softening point of 70° to 150° C., preferably 80° to 150° C., is fed-in through line 12 into the preheater and mixer 1. Condensed pyrolysis products coming from the fractionating column 5 are fed via the lines 9, 10, 11 to the preheater and mixer 1 and therein mixed with the coal-tar pitch. The sensible heat of the pyrolysis condensate is utilized here completely for heating the raw pitch. The heat content contributed by the condensed pyrolysis products constitute up to about one-quarter of the heat required to heat pitch to a temperature of about 100° to 200° C. above the softening point of the pitch. The mixture of pitch and pyrolysis condensate is composed of about 70 to 95% coal-tar pitch and 5 to 30% recirculated pyrolysis oil. Higher pitch contents affect the filterability adversely and, because of the incomplete separation of the quinoline-insoluble components, also result in a pitch coke which has a higher thermal volume expansion coefficient. Lower pitch contents cause an undersirable reduction of the coke yield.

0.5 to 5% kieselguhr are added to the mixture via the line 13 and the mixture is heated to a temperature about 100° to 200° C. above the softening point of the pitch. The mixture is then fed through line 19 to a pressure filter 2 and filtered with a pressure difference of about 1 to 8 bar. The specific filter output is about 500 kg/m$^2$hr. The filtrate from the filter 2 is fed through line 20 to the tubular heater 3, wherein it is heated to about 450° to 525° C. Coking of the filtrate in heater 3 is prevented by conducting the heating in known manner by turbulent flow, high velocities or a short time at a temperature and pressure in which coke deposition in the tube does not occur. The filtrate, heated to 450° to 525° C., is drawn from the tubular heater via the line 21 and introduced into coking drums 4 maintained at a pressure of between 1 and 6 bar and an overhead i.e. a temperature at or near the top of the drum where the volatile constituents are released of about 450° to 490° C. The coke formed is periodically removed from the drum 4; this is schematically indicated by the arrow 17. The overhead product from coking drum 4 is released through the line 22 and split into fractions in the fractionating column 5 with an overhead temperature of between about 150° and 200° C. at pressures of about 0.5 to 2 bar and a bottom temperature of about 300° C. In fractionating column 5, the gases and vapors from coking drum 4 entering through line 22 are separated into a gaseous product released from the top of column 5 through line 8 and a plurality of liquid fractions with the lowest boiling or most volatile fraction withdrawn from the side of column 5 through line 9 and the next higher boiling fraction withdrawn through line 10, and the highest boiling fraction withdrawn from the bottom of column 5 through line 11. Although it is preferred to recirculate the higher boiling fractions, the lower boiling fractions may be recirculated in part or whole in admixture therewith. Fractions from column 5 containing gases and highly volatile oils may be fed to burners 7 and 6, which are provided for heating the preheater 1 and the tubular heater 3. Other fuels entering burner 7 through line 14 and burner 6 through line 15 may be used in part or entirely to heat preheater mixer and/or tubular heater 3. Part of the condensed pyrolysis fractions are drawn off via lines 9, 10, 11 and fed to the preheater 1 and mixed with the raw pitch entering through line 12. The amount and proportion of each fraction returned will vary depending on the character of the pitch. In general the heavier fractions will predominate. Another part of the pyrolysis oils may be burned in the burner 6 for heating the tubular heater 3, particularly the low boiling fraction from line 9.

Figure 2:
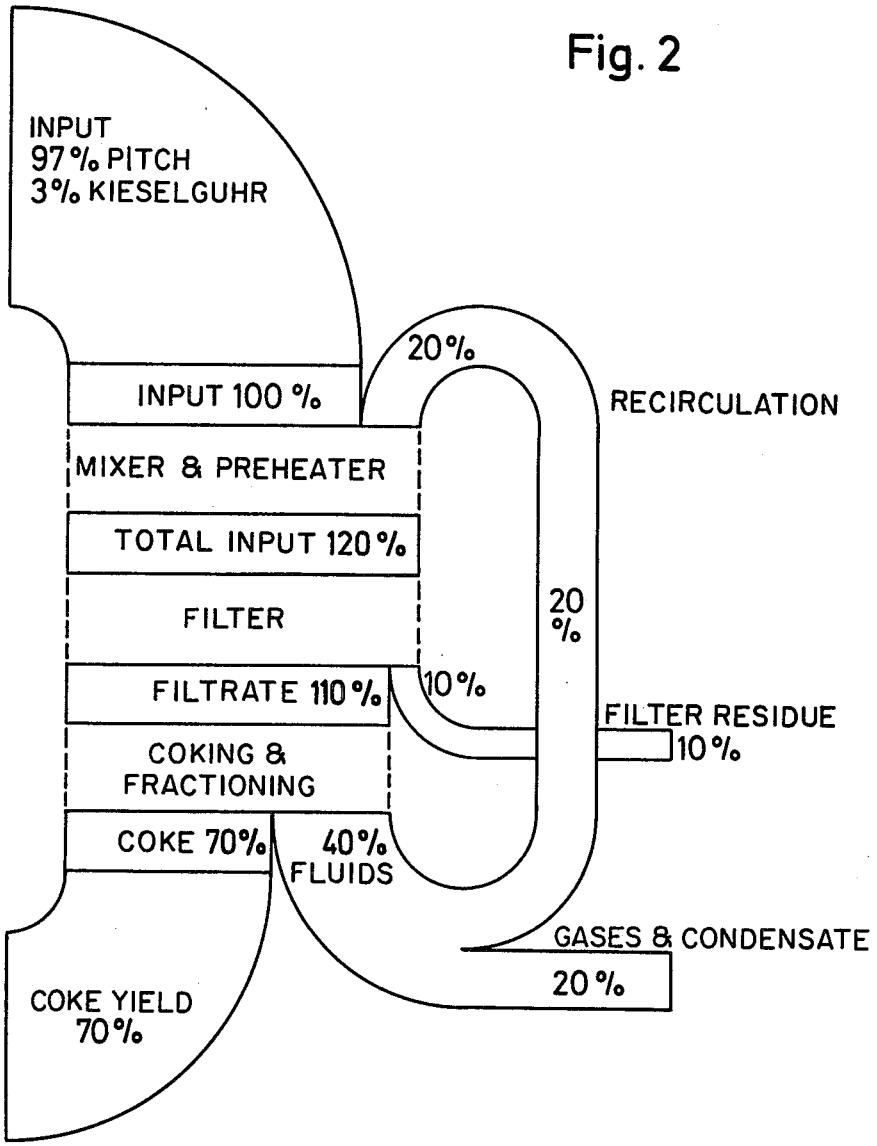
FIG. 2 is a material balance diagram of the materials flowing in the process of the present invention.

FIG. 2 schematically shows an example of the mass balance of the method in accordance with the invention. 97 parts coal-tar pitch and 3 parts kieselguhr are fed into the preheater 1 and mixed with 20 parts of pyrolysis condensate, so that 120 parts enter the filter 2. The filter residue or filter cake remaining in the filter is on the average 10 parts. The filtrate consisting of 110 parts are fed into the tubular oven and the coking drum. 70 parts coke are produced, corresponding to a coke yield of about 70% based on the input or feed charge of pitch, and 40 parts volatile matter, of which 20 parts are recirculated into the preheater. 20 parts (gases and highly volatile components) are used as fuel.

Figure 3:
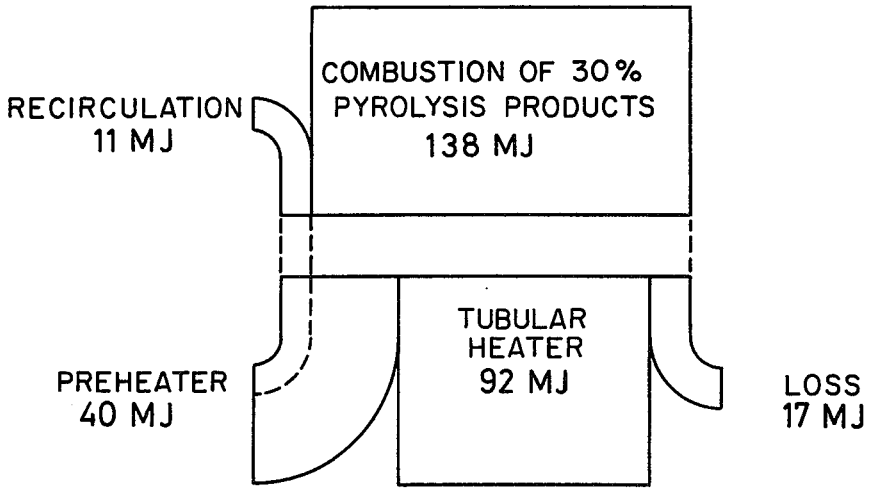
FIG. 3, an energy balance diagram in the method of the invention.

FIG. 3 shows an example of an energy balance. The energy requirement for heating 10 kg pitch including kieselguhr to about 220° C. is approximately 40 megajoules. In the tubular heater, the filtrate and recirculated pyrolysis products are heated from 220° to about 500° C., for which 92 megajoules are required. The heat losses, finally, are about 17 megajoules or about 13%. The heat requirement is covered by combustion of 30% of the pyrolysis products and by the sensible heat of the recirculated fractions which supply about 138 megajoules and 11 megajoules, respectively, to the process.

The following examples illustrate the present invention:

EXAMPLE 1

A coal-tar pitch with a softening point of 80° C. and quinoline-insoluble component content of 8.5% is mixed in the preheater 1 with recirculated pyrolysis products in the ratio of 9 : 1 and the mixture heated to 230° C. After adding 1% kieselguhr, the mixture is filtered in filter cartridges with metal filter inserts and gap widths of about 100 μm, the necessary pressure rising with the filtration time from about 1.5 to 5 bar pressure difference. The filter output was determined as 500 kg/m²hr. The softening point of the filtrate was 55° C. and the content of quinoline-insoluble substances as less than 0.1%. The filtrate was heated in the tubular heater 3 to about 480° - 510° C. and coked in the coking drums 4 at a temperature of 450° to 510° C. at a pressue of 1 to 5 bar. The coke yield was 72%. The green coke is calcined in known manner by heating it in rotary or disk ovens.

The characteristic properties of a coke have heretofore been determined indirectly principally by measurements on test bodies which contain, in addition to coke granules, a coked binder as a filler. In addition to the relatively long time it takes to prepare the test bodies, particularly the imprecision of the method due to the effect of the preparation parameters, is a disadvantage. More suitable for characterizing a coke are direct measurements such as, for instance, the determination of the thermal volume expansion coefficient on cubes cut from larger pieces of coke. With this method the following values (20° to 200° C.) are determined for known coke grades:

Fluid coke — 14 to 16 $\times 10^{-6}$/K
Bituminous coal tar asphalt coke — 12 to 14 $\times 10^{-6}$/K
Normal oil coke — 6 to 10 $\times 10^{-6}$/K
Needle coke — 4 to 6 $\times 10^{-6}$/K
(the coke samples were always heated for 6 hours to 1300° C. prior to the measurement).

The thermal volume expansion coefficient of the pitch coke prepared under the above-mentioned conditions was only 2.8 $\times 10^{-6}$/K.

As the thermal volume expansion coefficient correlates well with the visually recognizable texture and the degree of anisotropy of the cokes, this quantity can be used as a useful measure for the quality of cokes and their suitability for the manufacture of thermally and electrically heavily stressed graphite bodies. Extrusion-molded graphite bodies which contain a coke with a thermal expansion coefficient smaller than 2.8 $\times 10^{-6}$/K, exhibit, for example, a very small linear thermal expansion coefficient in the pressing direction (less than 0.6 $\times 10^{-6}$/K) and, surprisingly, also a small linear expansion coefficient in the radial direction (less than 1.8 $\times$ 10 $\times 10^{-6}$/K). Such graphite bodies are suitable, due to the excellent resistance against temperature variations and temperature gradients as electrodes for heavy-duty arc furnaces in steel making.

EXAMPLE 2

The coal-tar pitch with a softening point of 80° C. used in Example 1 was mixed with recirculated pyrolysis products in the ratio 95 : 5 and 75 :25 and filtered and coked as in Example 1.

| | | |
|---|---|---|
| Mixing ratio | 95 : 5 | 75 : 25 |
| Speed of filtration | 400 kg/m²hr | 700 kg/m²hr |
| Quinoline-insolubles in filtrate | 0.2% | less than 0.1% |
| Coke yield | 76% | 66% |
| Thermal volume expansion coefficient | 3.5 $\times 10^{-6}$/K | 1.6 $\times 10^{-6}$/K |

With decreasing content of recirculated pyrolysis products, the coke yield increases, but the quality of the coke and also the filtration efficiency are not as good.

EXAMPLE 3

Two coal-tar pitches with softening points of 136° and 71° C., respectively, were mixed together in the ratio 20 : 80 and with 10% by weight of recirculated pyrolysis oil and the mixture was filtered and coked as in Example 1.

Speed of filtration — 550 kg/m²hr
Quinoline-insolubles in filtrate — less than 0.1%
Coke yield — 75%
Thermal volume expansion coefficient — 1.9 $\times 10^{-6}$/K Pitch cokes prepared from such pitch mixtures exhibit a better quality than cokes from a single pitch for the same coke yield. Also the filterability of pitch mixtures is more favorable.

The advantages of the method according to the invention and of the pitch coke produced in accordance with the method are illustrated by the Examples. The pitch mixed with a recirculated pyrolysis product can be filtered with high efficiency; the filtrate contains only slight quantities of harmful tar ingredients and provides a higher coke residue than pitch mixtures with foreign oil additions. Recirculation of the pyrolysis products, in addition, permits improved thermal efficiency. Finally, the coke with needle-like texture produced in accordance with the method is distinguished by an unusually low thermal volume expansion coefficient of less than 4 $\times 10^{-6}$/K.

There are claimed:

1. Method for the manufacture of pitch coke with needle-like structure which comprises:
   (a) mixing pyrolysis oil condensate formed in the coking of coal-tar pitch with a coal-tar pitch having a softening point between 70° and 150° C. in the proportion of 70 to 95% by weight coal-tar pitch and 5 to 30% by weight pyrolysis oil condensate,
   (b) filtering said mixture of condensate and pitch at a temperature 100° C. to 200° above the softening point of the pitch,
   (c) passing the filtrate in a restricted stream through a heating zone and heating the filtrate therein to a temperature between about 450° and 525° C.,
   (d) discharging the thus heated filtrate to a coking chamber wherein the heated filtrate forms a non-volatile carbonaceous residue as coke and volatile vapor and gas,
   (e) releasing the volatile vapor and gas from the coking chamber and passing the vapor and gas to a fractionating zone with an overhead temperature of between about 150° and 200° C. at pressures of about 0.5 to 2.0 bar and a bottom temperature of about 300° C., in which the vapor is condensed to form pyrolysis oil condensate,
   (f) withdrawing said condensate from the fractioning zone, and returning at least a part of said condensate for mixing with additional incoming coal-tar pitch prior to said filtering.

2. Method according to claim 1, wherein the coal-tar pitch has a softening point between 80° and 150° C.

3. Method according to claim 1, wherein at least two coal-tar pitches are used, the softening points of which differ by more than 20 K.

4. Method according to claim 1, wherein the pitch filtrate is coked by delayed coking.

5. Method according to claim 1, wherein said heating zone is a tubular heater.

* * * * *